United States Patent [19]

Harman et al.

[11] 4,260,136

[45] Apr. 7, 1981

[54] SUSPENSION HOOK ASSEMBLY

[75] Inventors: James R. Harman; William M. Larson, both of Forrest City; J. B. Threat, Crawfordsville, all of Ark.

[73] Assignee: Eaton Corporation, Cleveland, Ohio

[21] Appl. No.: 126,623

[22] Filed: Mar. 3, 1980

Related U.S. Application Data

[63] Continuation of Ser. No. 938,194, Aug. 30, 1978, abandoned.

[51] Int. Cl.[3] ..... B66D 3/00

[52] U.S. Cl. ..... 254/380; 254/372

[58] Field of Search ..... 254/169, 167, 170, 171, 254/163, 164, 192, 195, 196, 154, 380, 358, 342, 372, 213, 219, 220, 348; 29/463, 434; 403/143, 142, 362, DIG. 7; 248/339

[56] References Cited

U.S. PATENT DOCUMENTS

| | | | |
|---|---|---|---|
| 687,864 | 12/1901 | Smyth | 403/DIG. 7 |
| 2,393,550 | 1/1946 | Meinert | 403/326 |
| 2,503,682 | 4/1950 | Parker | 254/372 |
| 2,980,988 | 4/1961 | Vice | 29/463 |
| 3,165,856 | 1/1965 | Gourley, Jr. | 254/192 |
| 3,369,795 | 2/1968 | Fujita | 254/348 |
| 3,894,720 | 7/1975 | Koji | 254/342 |

FOREIGN PATENT DOCUMENTS 1050029 4/1953 France .

*Primary Examiner*—Billy S. Taylor
*Attorney, Agent, or Firm*—R. J. McCloskey; F. M. Sajovec, Jr.

[57] ABSTRACT

A suspension hook assembly for a hoist in which the shank of the hook is received between an assembled pair of half-cylindrical members held together by a ring. A pin member received between spaced frame members of the hoist extends through aligned holes in the assembled half-cylindrical members, and the ring is positioned axially between the pin and outwardly directed projections formed on the half-cylindrical members. The hook then pivots about a first axis through its shank, and the hook assembly pivots about a second, perpendicular, axis through the pin.

5 Claims, 3 Drawing Figures

SUSPENSION HOOK ASSEMBLY

This is a continuation of application Ser. No. 938,194, filed Aug. 30, 1978 and now abandoned.

The present invention relates to hoists, and more particularly to a hand lever hoist frame construction.

Hand lever hoists are generally subject to rough usage, for example, in shipyards and railyards. As such they must be ruggedly constructed; however, at the same time they must be designed for easy assembly and disassembly from the standpoint of both low initial cost and ease of maintenance.

The particular improvement which the present invention provides is in the structure of the suspension hook for the hoist. Since a hand lever hoist is portable, it must function in a variety of positions, and to adapt the hoist for such use, it is important that the suspension hook be able to swivel about two mutually perpendicular axes. Since the suspension hook can be subjected to extreme wear, it must also be easily replaceable.

In prior art hoists, as illustrated in U.S. Pat. No. 3,894,720, multiple axis swiveling has been obtained by providing a two-piece yoke fastened together by bolts or similar external fasteners, which retain the suspension hook while permitting rotation of the hook about an axis parallel to the load line of the hoist, and mounting the yoke for pivotal movement about an axis perpendicular to the load line, by means of a pin retained by the frame of the hoist.

What the present invention seeks to provide is a means for mounting a hoist suspension hook which permits the hoist to swivel about two axes, using a minimum number of separate parts, and which is easy to assemble.

To meet the above objective, the present invention provides a yoke formed of two half-cylindrical members which retain the shank of the hook for rotation about the axis of the shank. The yoke is mounted to the hoist for rotation about an axis perpendicular to the shank axis by means of a pin extending through spaced frame members of the hoist, and through both of the yoke halves. The yoke halves are held together by means of a ring which encircles the assembled yoke halves and is captured between a shoulder defined by projections formed on each yoke half and the pin.

Figure 1:
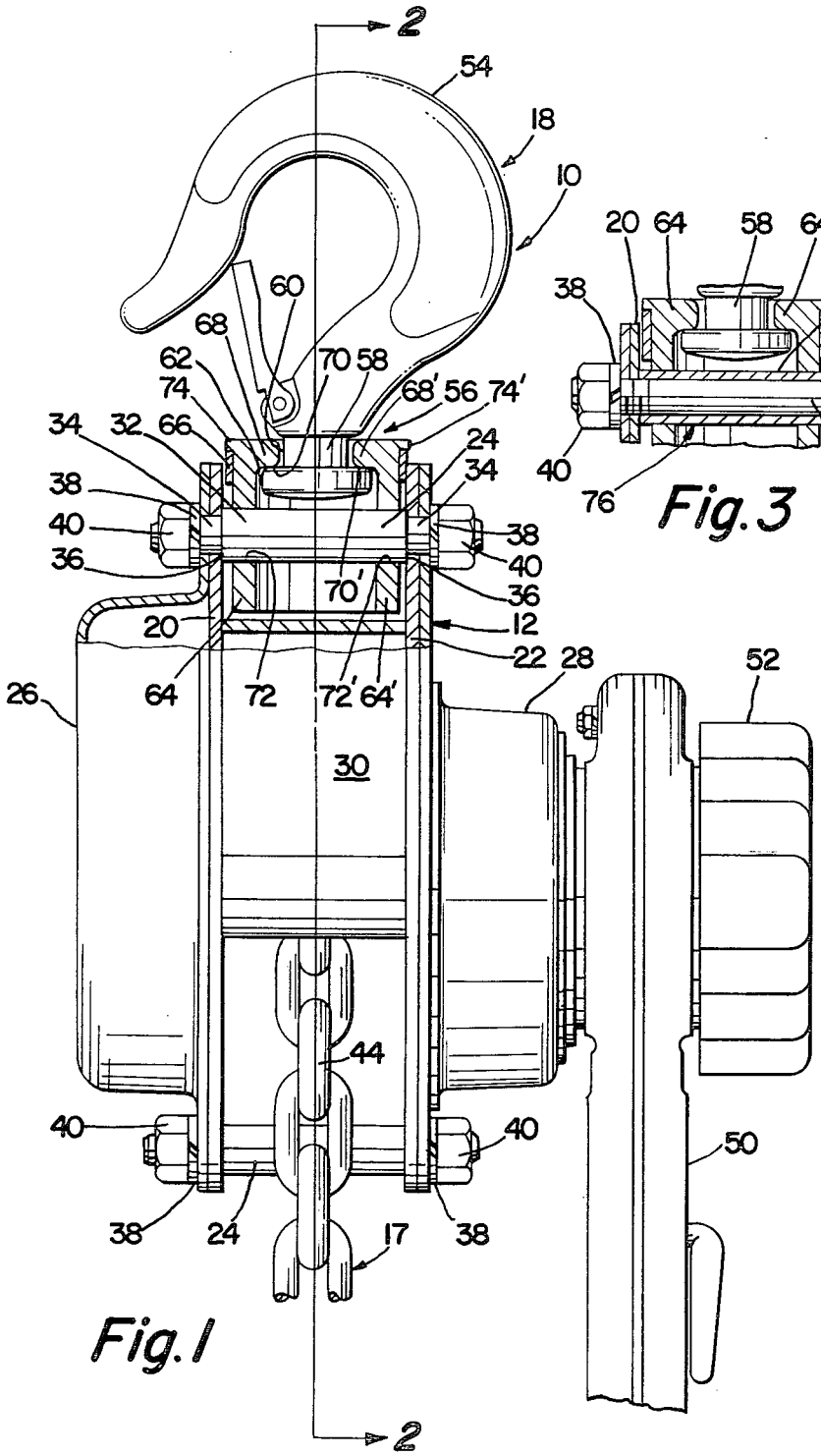
FIG. 1 is a front elevation of a hand lever hoist incorporating the invention, with parts shown in section.

In the drawings there is illustrated a hand lever hoist designated generally by the numeral 10. The hoist mechanism for lifting, lowering, and maintaining a load form no part of the present invention, and will not be described in detail herein.

Figure 2:
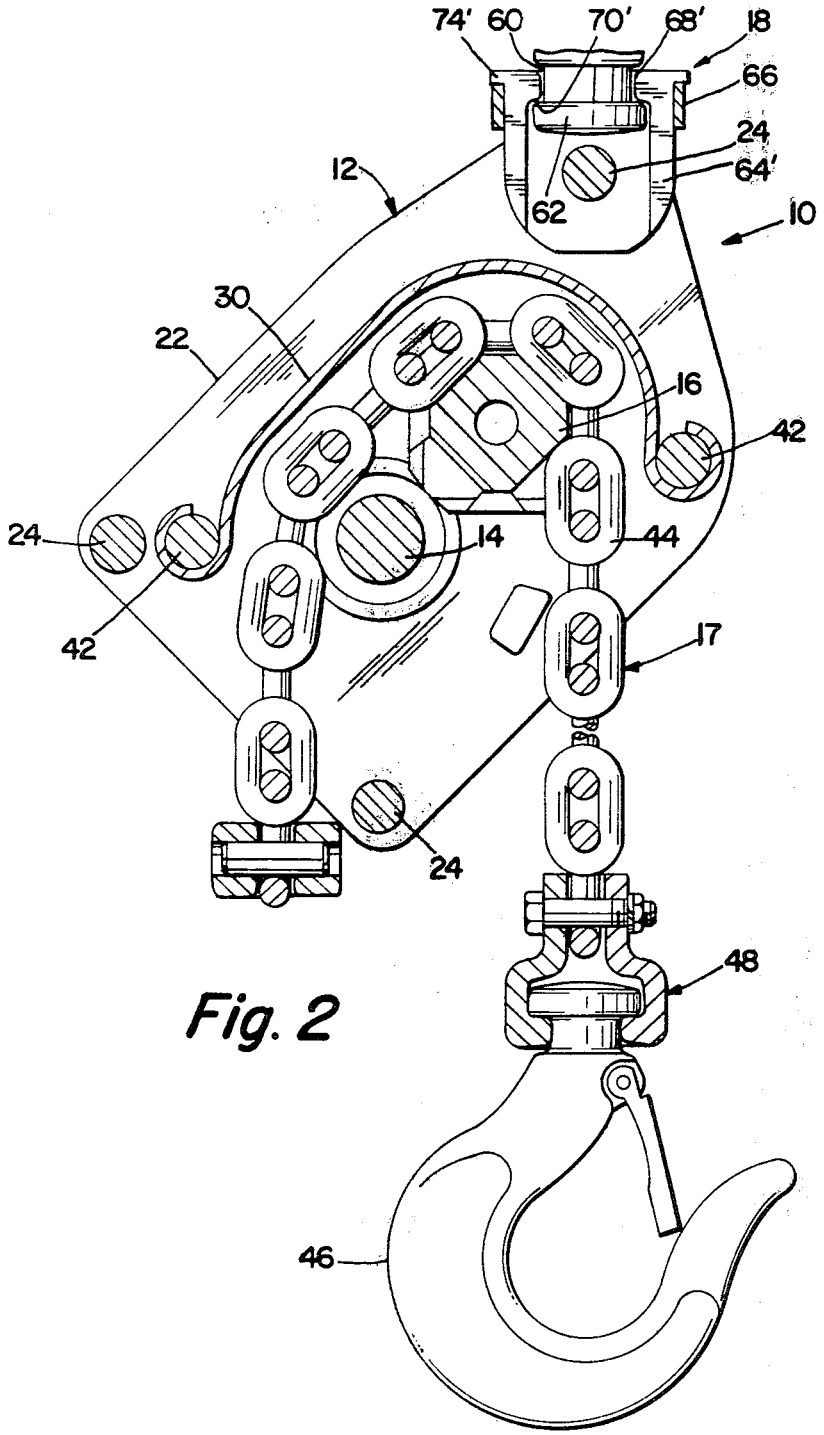
FIG. 2 is a sectional view taken along line 2—2 of FIG. 1.

Referring to FIG. 2 the hoist 10 essentially comprises a frame assembly 12, an input shaft 14, an output sheave 16, a load chain assembly 17, and a suspension hook assembly 18.

The frame assembly 12 comprises a first frame member 20; a second frame member 22, which is spaced from the first frame member by means of a plurality of shouldered pins 24; a gear cover 26 attached to the first frame member 20; a clutch cover 28 attached to the second frame member 22; and a cover plate 30 partially closing the space between the frame members 20 and 22.

Each of the pins 24 comprises a first cylindrical portion 32 and reduced diameter portions 34 at each end which define shoulders 36 bearing against the frame members 20 and 22. The ends of the reduced diameter portions are threaded.

The covers 26 and 28 are received over the reduced diameter portions 34, and the entire frame assembly is secured by means of lockwashers 38 and nuts 40 received on the threaded portions of the pins 24. The cover plate 30 is a single piece of sheet having its ends rolled over pins 42 received in holes formed in the frame members 20 and 22 and retained by the covers 26 and 28.

The input shaft 14 extends through the clutch cover 28 and through both frame members 20 and 22. A gear train (not shown) located within the gear cover 26 connects the input shaft to the output sheave 16. The load chain assembly 17 comprises a load chain 44 received between the frame members 20 and 22, around the input shaft 14, and over the output sheave 16; and a load hook 46, which is attached to the output end of the chain by means of a conventional yoke assembly 48.

An operating handle 50 is connected to the input shaft 14 through a conventional Weston load brake (not shown) located within the clutch cover 28, and is retained thereon by means of a handwheel 52.

The suspension hook assembly 18 comprises a hook 54, and a yoke assembly 56. The hook includes a shank 58 having a portion of reduced diameter 60 and a head 62 formed thereon.

The yoke assembly comprises two generally semi-cylindrical yoke halves 64 and 64' which fit over the shank of the hook, and a closed retaining ring 66 which encircles the assembled yoke halves and retains them together to define the cylindrical yoke assembly 56. Semi-annular projections 68 and 68' formed on the inside of each yoke half define shoulders 70 and 70' against which the head 62 of the hook 54 is stopped when the two halves are assembled. Holes 72 and 72 are formed in each yoke half to receive the upper pin 24 to attach the yoke assembly 55 to the hoist frame assembly 12. The pin 24 has a clip fit in the holes 72 to permit rotation of the hook assembly 18 about the pin.

The retaining ring 66 is sized to fit between the holes 72, 72' and outwardly extending lips 74 and 74' formed on each yoke half 64, 64'.

The hook assembly is assembled by assembling the yoke havles 64, 64' over the hook shank 58 with the inwardly directed projections 68, 68' received over the reduced diameter portion 60. The retaining ring 66 is then slipped over the assembled yoke halves.

In the preferred embodiment, internal hoist components such as the input shaft 14, output sheave 16 and gear train, are first assembled in relation to the first frame member 20. With the pins 24 and 42 and the gear cover 26 also assembled to the first frame member, and the left side lockwashers 38 and nuts 40 secured to the pins 24, the yoke assembly 56 is slipped over the upper pin 24 from the right side as shown in FIG. 1, and cover plate 30 is slipped over pins 42. The second frame member 22, Weston brake components, and the brake cover 28 are then placed over the pins 24, and the lockwashers 38 and nuts 40 on the right side added. Handle assembly 50 and handwheel 52 are added last.

When the hoist 10 is assembled, the retaining ring 66 is captured between the lips 74, 74' and the pin 24. The suspension hook 54 is free to rotate about its shank 58, and the suspension hook assembly 18 is free to rotate about the upper pin 24.

Figure 3:
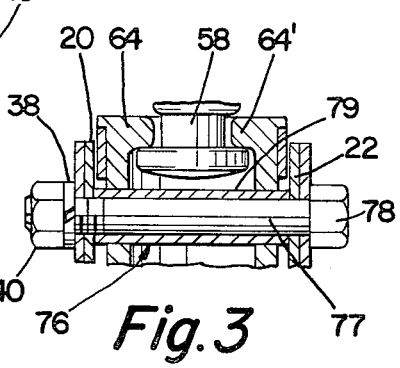
FIG. 3 is a fragmentary sectional view of an alternative embodiment of the invention.

In FIG. 3 there is illustrated an alternative embodiment in which the upper pin 24 is replaced by a pin assembly 76. The pin assembly 76 comprises a bolt 77 having a head 78 formed thereon, a bushing 79 received over the bolt between frame members 20 and 22, and the lockwasher 38 and nut 40. In accordance with this embodiment the suspension hook assembly 18 can be installed and removed with the hoist 10 otherwise completely assembled.

We claim:

1. In a hoist comprising a first frame member, a second frame member, a plurality of pin members extending through said first and second frame members and maintaining said first and second frame members in fixed spaced relationship to one another, and a suspension hook assembly received between said first and second frame members and pivotally attached to said frame members, said suspension hook assembly comprising a yoke assembly and a hook member pivotally received in said yoke assembly; the improvement wherein said hook member includes a substantially cylindrical shank portion, and said yoke assembly comprises first and second half-cylindrical members assembled in surrounding relation to said shank portion, and a closed ring received over said assembled half-cylindrical members, each of said half-cylindrical members having a radial projection extending outwardly therefrom and a hole formed therein to receive one of said pin members, said ring being received between said projections and said holes.

2. Apparatus as claimed in claim 1, in which said shank portion comprises a cylindrical portion and a head portion, and each of said half-cylindrical members has an inwardly directed radial projection formed thereon, said projections being received over said head portion when said half-cylindrical members are in their assembled condition.

3. Apparatus as claimed in claim 1, in which said holes formed in said half-cylindrical members are sized to provide a slip fit over said pin member.

4. Apparatus as claimed in claim 1, including said one pin member, said one pin member comprising a solid cylindrical member and a bushing member fitting over said solid member, said bushing member being of substantially the same length as the spacing between said first and second frame members.

5. Apparatus as claimed in claim 4, in which the outer diameter of said bushing member and the diameter of said holes formed in said half-cylindrical members are selected to provide a slip fit between said holes and said bushing member.

* * * * *